United States Patent [19]

Seberger, Jr.

[11] Patent Number: 4,576,083

[45] Date of Patent: Mar. 18, 1986

[54] DEVICE FOR SILENCING FIREARMS

[76] Inventor: Oswald P. Seberger, Jr., P.O. Box 377, Shingletown, Calif. 96088

[21] Appl. No.: 558,375

[22] Filed: Dec. 5, 1983

[51] Int. Cl.[4] ..... F41C 21/18

[52] U.S. Cl. ..... 89/14.4; 181/223

[58] Field of Search ..... 89/14.4; 181/223, 249, 181/250, 251

[56] References Cited

U.S. PATENT DOCUMENTS

| | | | |
|---|---|---|---|
| 1,017,003 | 2/1912 | Kenney | 89/14.4 |
| 1,081,348 | 12/1913 | Unke | 89/14.4 |
| 1,111,202 | 9/1914 | Westfall | 89/14.4 |
| 1,427,802 | 9/1922 | Goodwin | 89/14.4 |
| 3,748,956 | 7/1973 | Hubner | 89/14.4 |
| 4,291,610 | 9/1981 | Waiser | 89/14.4 |

FOREIGN PATENT DOCUMENTS

| | | | |
|---|---|---|---|
| 63622 | 2/1914 | Fed. Rep. of Germany | 89/14.4 |
| 564536 | 6/1957 | Italy | 181/223 |

*Primary Examiner*—Charles T. Jordan
*Assistant Examiner*—Ted L. Parr

[57] ABSTRACT

A cylindrical silencer tube is fastened to the muzzle of a firearm. The interior of the tube is equipped with a series of chambers and conically shaped baffles which direct part of the discharge gases and sound waves in a different path from the main discharge and then causes them to reunite before they discharge the silencer at a point where part of the sound waves have been delayed and are hence out of phase with the principal waves and cause elimination of the noise. Specially constructed inlet and outlet chambers within the tube aid in the suppression of the sound waves and deafening of the noise. The exterior of the cylindrical silencer tube is equipped with a series of cooling fins to aid in the dissipation of heat from the silencer.

9 Claims, 12 Drawing Figures

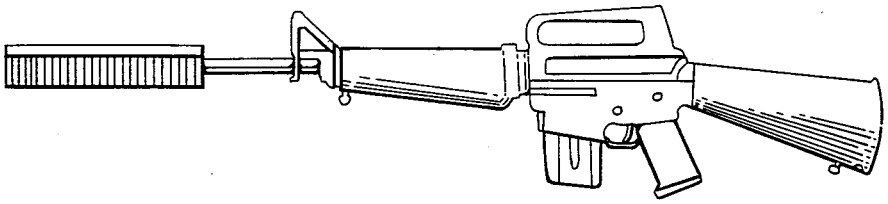
FIG. 1
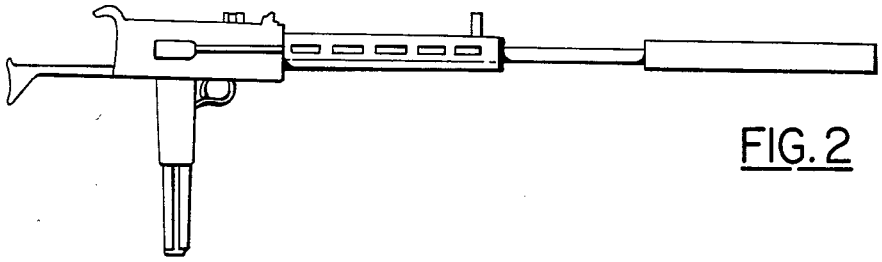
FIG. 2
FIG. 3 FIG. 4
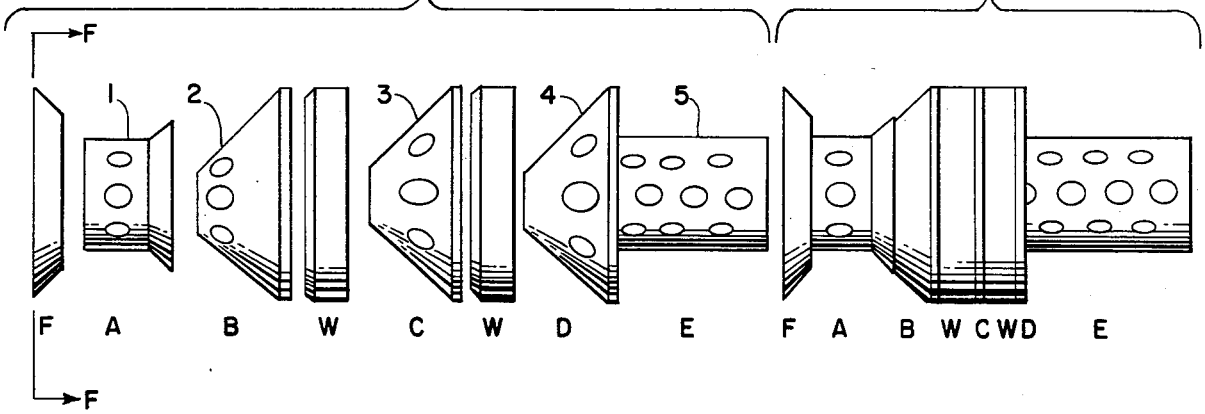
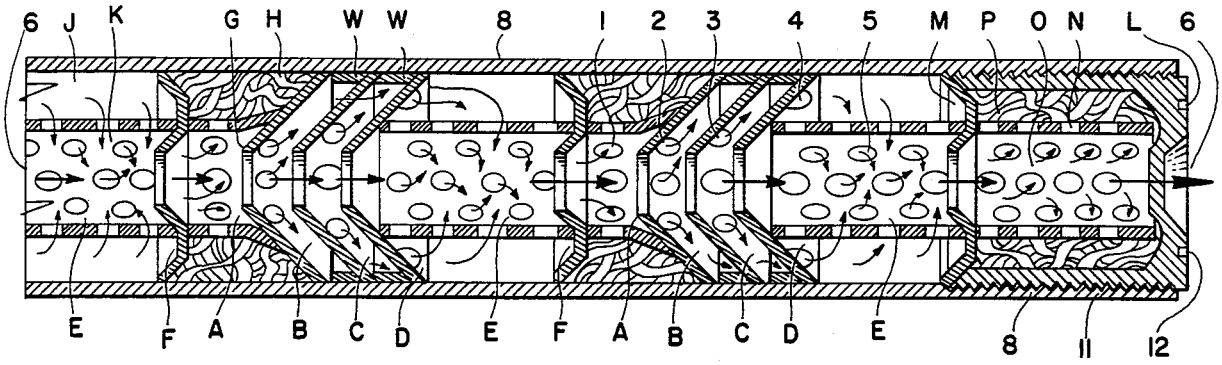
FIG. 5

DEVICE FOR SILENCING FIREARMS

BACKGROUND OF THE INVENTION

1. Field of the Invention

This generally takes the form of different baffling and path diversion means for the discharge gases in order to effect their throttling and other interference of progress of the sound whereby the gases and sound are muffled.

2. Description of the Related Art

Prior art patents insofar as they are known to applicant at this time are set forth below.

U.S. Pat. No. 916,885 to H. P. Maxim utilizes a rectangular casing attached to the muzzle of the weapon and containing a series of chambers with vanes to give the gases a circular motion in succession. The centrifical motion dissapates the energy, reducing pressure and noise until they escape from the last chamber.

U.S. Pat. No. 958,934 to H. P. Maxim is an improvement on his previous patent. In this he utilizes a series of spreaders which give a rotary motion in each chamber, but includes also inclined baffles which direct gases back towards the projectile path to collide with the gases from the centrifical core. He employs an eccentric entrance to the silencer also forcing gases to one side instead of folowing the projectile.

U.S. Pat. No. 1,017,003 to C. H. Kenney utilizes a cylindrical tube with a plurality of cup-shaped discs with conical central portion in line facing the gases coming from the muzzle. Some of the gases pass through the central opening and others are diverted backwards and then forward to an expansion chamber near the outlet. It utilizes an equalizing chamber for gases at the muzzle end, forming a perforated baffle across the chamber.

U.S. Pat. No. 1,066,898 to W. R. Gray utilizes an expansion chamber at the end adjacent to where his device, which is also a centrifical tube, is fastened to the muzzle. He utilizes an inner tube in which there is a plurality of spirally shaped baffles which divert gases to cylindrical chambers spaced around the outside of the tube and along its length. Gases enter these expansion chambers where they expand and escape through suitable apertures back to the inner tube after pressure has been reduced.

U.S. Pat. No. 1,427,802 to G. A. Woodwin. This utilizes two concentric cylindrical casings with a space in between. It employs baffles in the inner casing and apertures in it comunicating with the outer casing which is closed off at its outer end. The gases are passed through a series of baffles in the inner casing where they are expanded and are directed through the apertures to the outer casing and backwards toward the gun muzzle where they discharge in the opposite direction from the movement of the projectile.

U.S. Pat. No. 2,375,617 to R. B. Bourne. In this the cylindrical tube attached to the muzzle leads first to an expansion chamber and then to a series of whirl chambers where the gases are successively given centrifical motion as they expand down through the silencer and on to the opposite end.

U.S. Pat. No. 2,514,996 to C. H. Faust, Jr. utilizes two concentric cylinders connecting to the muzzle. The inner casing comprises a series of cylindrical wire screens with barrel fittings. The outer casing is perforated. It employs conical baffles along the casing and the space between is filled with flaked asbestos. The gases pass through the asbestos where they are muffled before passing through the perforations in the outer casing to the outside.

U.S. Pat. No. 3,399,957 to W. E. Ferrine is constructed to reduce recoil as well as noise. The cylindrical device surrounds the barrel which is equipped with ports which lead to volute shaped annular barrels which alternately spin gases in opposite directions as they pass from one to the other and back into the body of the device. The resultant reactive effect is to cut down noise and prevent recoil.

U.S. Pat. No. 3,500,955 to M. L. Werbell uses a cylindrical tube attached to the end of the barrel, as do most the others. The first part of the tube comprises an entry and resonant chamber and the remainder is a series of oppositely wound helical screws with spaces between the members of the helical screws, the spaces communicating with the central opening for the path of the projectile permitting the gases to exit into the helices where they are alternately given rotation in opposite directions as the gases pass down through the tube toward the outlet where there is located a resonant chamber. Such baffling is alleged to minimize the noise before the gases are discharged.

None of the prior art utilizes the method provided by applicant's device which consists of separating the central gas and sound wave flow down through the projectile tube by means of cylindrical and frustro-conical baffles in series. These are so arranged as to divide the flow so that part of the gases and sound waves is deflected outward successively by the conical members passing through holes in them and then reuniting through a cylindrical member to contact the central gas flow after it has been substantially delayed in action and is out of phase with the main flow so that the two flows collide to dampen one another, thus practically eliminating the noise.

SUMMARY OF THE INVENTION

The method provided by the applicant's device consists of separating the central gas and sound wave flow down through the projectile tube by means of cylindrical and frusto-conical baffles in series. These are so arranged as to divide the flow so that part of the gases and sound waves is deflected outward successively by the conical members passing through holes in them and then reuniting through a cylindrical member to contact the central gas and sound flow after it has been substantially delayed in action and is out of phase with the main flow so that the two flows collide to dampen one another, thus practically eliminating the noise.

In addition to the deadening effect of the baffling arrangement described above, applicant also utilizes a special entry chamber and a sound absorbing exit chamber which are baffled to further decrease the pressure and the noise attendant to the bullet discharge.

Due to the high buildup of heat caused by the conversion of sound energy to heat, applicant provides a series of cooling fins affixed to the exterior of the cylindrical tube.

BRIEF DESCRIPTION OF THE DRAWINGS

Refering now to the Figures, there is shown on FIG. 1 the silencer of my invention positioned on the muzzle end of a U.S. Army Rifle M-16.

FIG. 2 is a view of my silencer in position on a Mac 10 carbine automatic weapon. My device is suitable for these and most other types of weapons.

FIG. 3 is an exploded view of the basic silencer unit showing the elements or component parts by letter.

FIG. 4 is one silencer unit with elements welded together.

FIG. 5 is a schematic longitudinal section of two of the units and part of a third unit plus the outlet elements L, M, N inside the silencer tube 8 and showing the travel of the gases and sound waves through the silencer.

DESCRIPTION OF A PREFERRED EMBODIMENT

Figure 6:
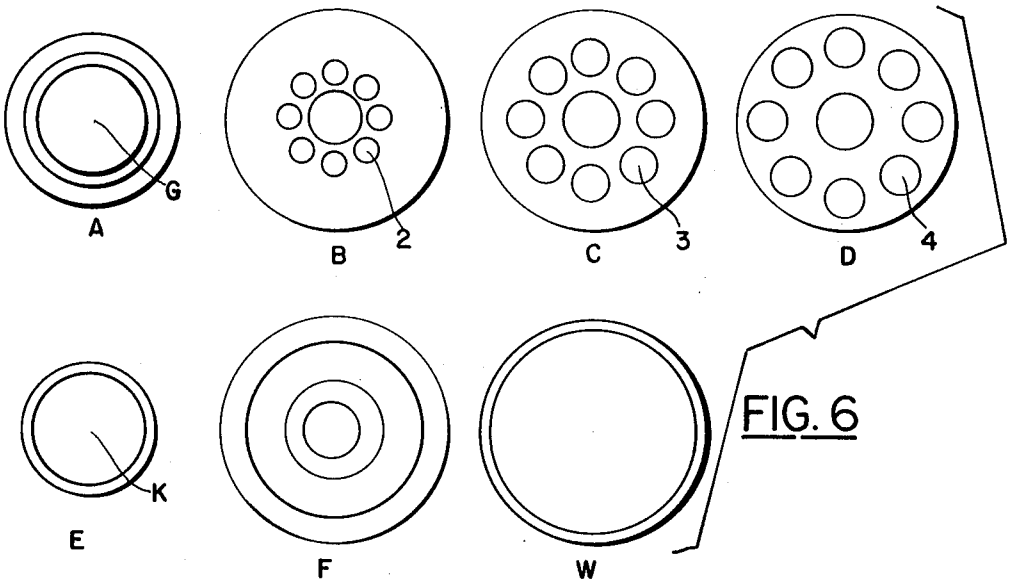
FIG. 6A through 6W show various sectional and end views of the elements of FIG. 3 as noted.

Referring now to the Figures and especially first to FIG. 3 there is shown the component parts, or elements, which comprise the heart of the silencer. These are as follows:

A is a hollow cylindrical shell with holes 1 and may be seen in end view along the lines F—F on FIG. 6A and side view in FIG. 3.

B is a conical baffling member with holes 2 through its sides located in the region adjacent to the apex of said cone, an end view of which may be seen on 6B and a side view in FIG. 3.

W is a hollow cylindrical washer, or spacer, an end view of which may be seen on 6W and a side view in FIG. 3. This spacer may be an integral part of said conical member B, and integral part of conical member C, and an integral part of conical member D.

C is a second conical baffling member having holes 3 through its sides located midway down the side of the cone, an end view of which may be seen on FIG. 6C and a side view in FIG. 3.

D is a third conical baffling member with holes 4 located in the region furthest from the apex of said cone, an end view of which may be seen on FIG. 6D and a side view in FIG. 3. The holes 2, 3, and 4 are of increasing size with hole 4 the largest.

E is a hollow cylindrical member, an end view of which may be seen on FIG. 6E and a side view in FIG. 3. A series of holes 5 are spaced around the periphery and longitudinally on said cylindrical member as shown.

Figure 8:
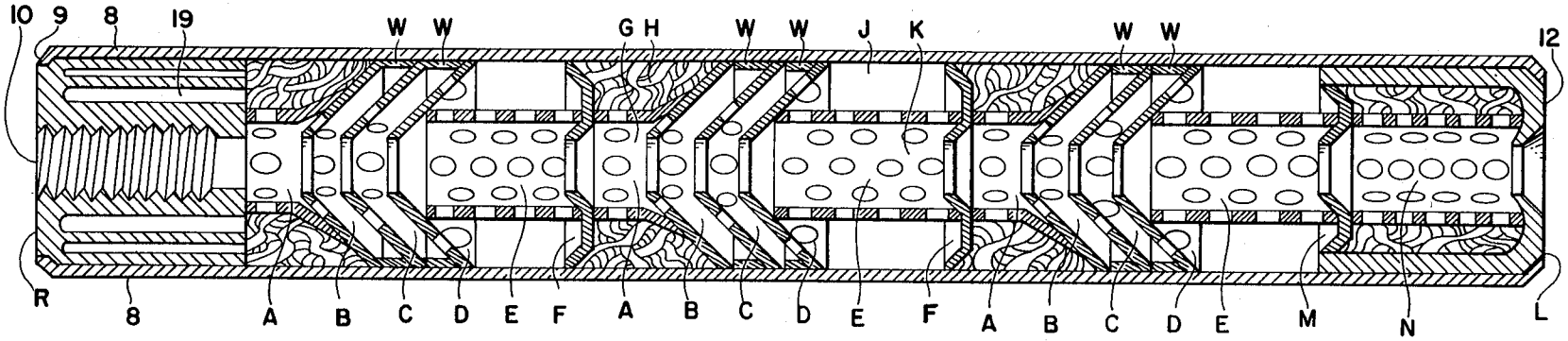
FIG. 8 shows a longitudinal section through the silencer tube 8 and shows in addition to the silencing elements of FIG. 5 the inlet element R and the outlet elements L, M, and N.

F is a flange member connecting with said cylindrical shell A and having a central conical portion opening with the apex end of said conical portion facing away from said cylindrical shell A, an end view of which may be seen in FIG. 6F and a side view in FIG. 3, and in longitudinal view in FIG. 5 and FIG. 8.

These elements are all welded together to form a unit as shown on FIG. 4 with elements F and E projecting and the remainder elements being welded together and representing an exterior cylindrical surface as shown.

Thus welded together, these elements comprise a single silencing unit of which several may be inserted in series in a silencer tube as explained more fully below.

G is a chamber formed by the interior walls of said hollow cylindrical shell A and is shown in longitudinal view in FIG. 5 and in end view in FIG. 6A.

H is a chamber formed by the exterior wall of said hollow cylindrical shell A and the interior wall of silencer tube 8 and is shown in longitudinal view in FIG. 5 and FIG. 8.

J is a chamber formed by the exterior wall of said hollow cylindrical member E and the interior wall of silencer tube 8 and is shown in longitudinal view in FIG. 5 and FIG. 8.

K is a chamber formed by the interior wall of said hollow cylindrical member E and is shown in longitudinal view in FIG. 5 and in FIG. 8 and in end view in FIG. 6E.

Figure 7:
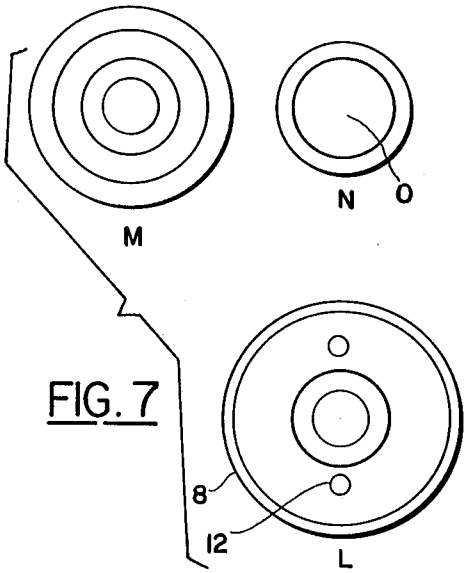
FIG. 7L shows exit end view of element L and silencer tube 8.
FIG. 7M shows an end view of element M.
FIG. 7N shows end view of element N.
Figure 9:
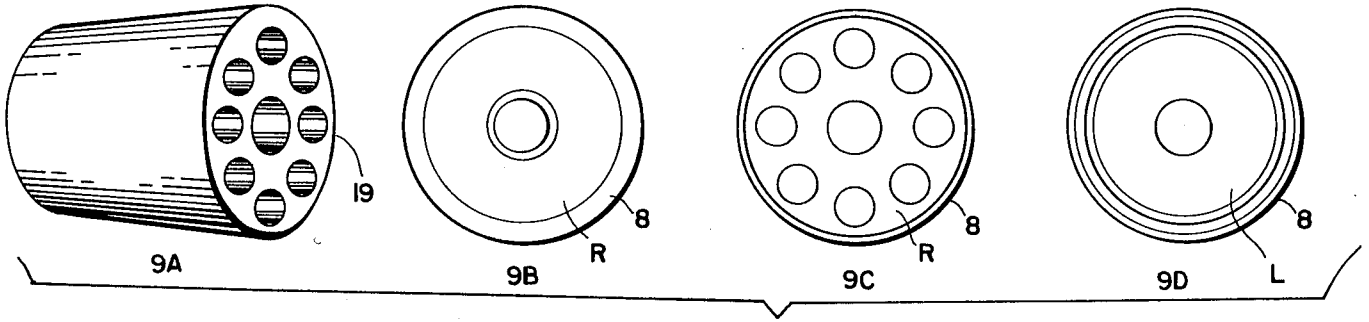
FIG. 9A shows a perspective view of element R.
FIG. 9B shows entrance end view of the silencer tube 8 including element R from the inlet end.
FIG. 9C shows exit end view of inlet element R and silencer tube 8 from the outlet side.
FIG. 9D shows entrance end view of outlet element L and silencer tube 8 from the inlet end.

L is a hollow cylindrical member with the exterior surface threaded, the interior is a hollow cavity that is open at the entrance end facing the muzzle of the firearm and is shown in end view in FIG. 9D, and the end opposite the said entrance end is the exit end and is shown in end view FIG. 7L and is shown in longitudinal view in FIG. 5 and FIG. 8.

M is a flange member affixed into the entrance end of said cupped hollow cylindrical member L and having a central conical portion opening with the apex end of said conical portion facing the muzzle of the firearm and is shown in end view in FIG.7M and in longitudinal view in FIG. 5 and FIG. 8.

N is a hollow cylindrical member, an end view of which may be seen in FIG. 7N and in longitudinal view in FIG. 5 and FIG. 8.

O is a chamber formed by the interior walls of said hollow cylindrical member N and can be seen in longitudinal view in FIG. 5 and FIG. 8, and in end view in FIG. 7N.

P is a chamber formed by the exterior wall of said hollow cylindrical member N and the interior wall of silencer tube 8 and can be seen in longitudinal view in FIG. 5 and FIG. 8 .

Referring now to FIG. 5, there is seen a longitudinal section through the tube and two of the silencing units and part E of a third unit and exit elements L, M, and N. The path of the projectile through the silencer is shown at 6. The elements A, B, C, D, E, F, and W are as designated in FIG. 3 except that they are now welded together to form a single unit. Elements L, M, and L comprise the exit end of the silencer. The first unit in the silencer does not include conical member F.

As thus assembled, these units and elements act as a silencer and flash suppressor and recoil reducer by deflecting the discharge gases and muffling the attendant sound waves which accompany them.

After the projectile is discharged through central hole 6 the gases accompanied by the sound waves travel in its path and encounter an obstruction or baffle formed by cone B and are deflected through the holes 1 in element A where they strike the interior of the silencer tube 8 and are dampened by the stainless steel wool in the chamber H formed by the exterior of tube A and the interior of the silencer tube 8.

Other portions of the discharge go directly into holes 2 in element B where they are again deflected and pass on to holes 3 in element C where further deflection by element D causes them to pass through holes 4 and out to chamber J and pass on to holes 5 in element E and into chamber K. Chamber J is formed by the exterior of cylindrical member E and the interior of the silencer tube 8. Chamber K is the interior of element E.

The remainder of the discharge and sound waves from the discharge passing directly through hole 6 enter chamber K.

Due to the delay of the passage of the gases and sound waves through the conical elements, they are out of phase with the ones passing through aperature 6. When they meet in chamber K they tend to neutralize, or cancel, one another out and thus eliminate the sound waves. Further passage along hole 6 and out of inverted cone F and into chamber G where the process is repeated through the next unit. After leaving the last unit the remaining sound waves pass through inverted cone M to chamber O. Chamber O is formed by the interior of cylindrical N. The sound waves travel outward into chamber P and are absorbed by the stainless steel wool in chamber P. Said chamber P is formed by the exterior of cylinder N and the interior of element L. Chamber P contains stainless steel wool to dampen the sound waves. The remaining sound waves in chamber O are attenuated as they are reflected from the sides of the cylindrical member N before passing through the central hole 6 in element L.

Description of entrance element R and exit element L are warranted at this time. Entrance element R is held in position in tube 8 by crimped and welded section of tube 8 shown in FIG. 8 and contains threaded section 10 for securing to the muzzle of the weapon. Element R is equipped with a plurality of axial holes 19 which contribute to the dampening effect of the sound waves.

Exit element L is secured to tube 8 by means of threaded section 11 and is equiped with holes 12 to accommodate a spandrel wrench for the purpose of tightening the whole assembly in position. Element L may also be secured to silencer tube 8 by the same manner that element R is secured to silencer tube 8.

The matter of heat dissipation from the silencer tube 8 is of considerable importance, particularly when used in connection with an automatic weapon that has a high energy level. Due to the fact that a high degree of the sound is converted to heat by the out of phase relationship of the sound waves, the heat buildup is directly related to the amount of energy converted from sound to heat.

Figure 10:
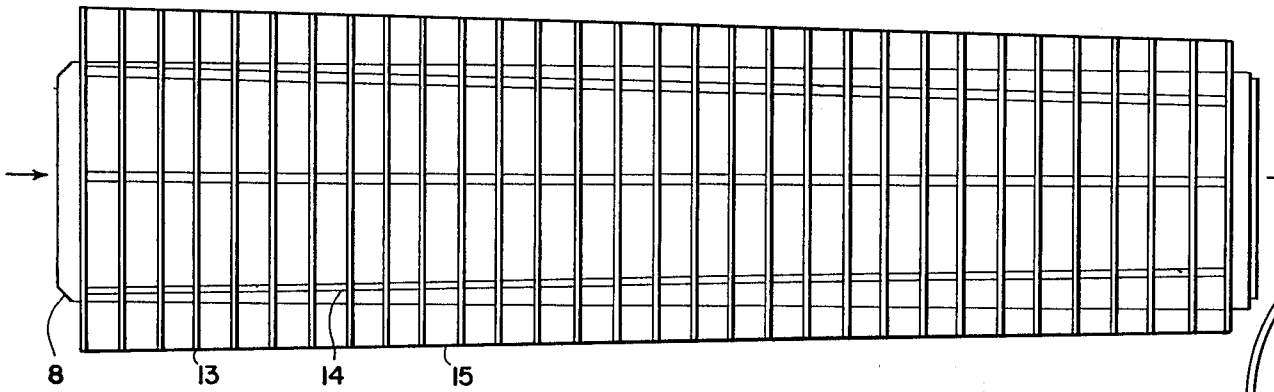
FIG. 10 shows a bottom longitudinal view of the tube 8 showing the cooling fins 13 in position on the tube 8 exterior and the stiffening members 14, or rods 14, passing through the fins 13.
Figure 11:
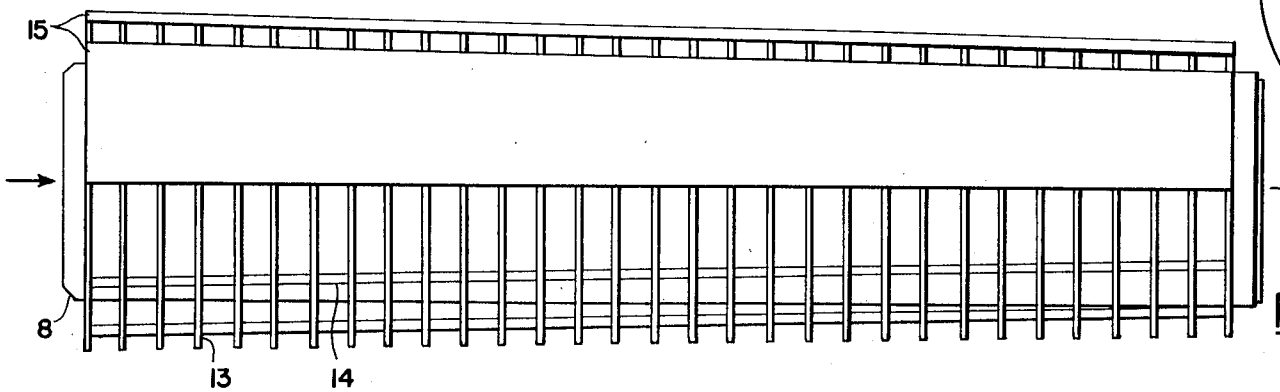
FIG. 11 shows the longitudinal elevation of the tube 8 showing the covered surface 15 over the cooling fins 13.
Figure 12:
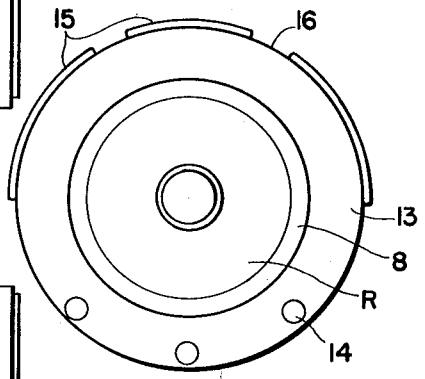
FIG. 12 shows an inlet end view of the tube 8 and cooling fins 13 and stiffening rods 14 and covered surfaces 15 and vent openings 16.

I provide cooling fins 13 as shown in FIGS. 10, 11, and 12. The fins are welded to silencer tube 8 for heat dissipation. They are held in alignment by horizontal rods 14 and equiped with a covered surface 15. The heat is passed through vent openings 16.

The cooling fins may, or may not, be used on the silencer.

A silencer thus installed om the muzzle of a weapon has produced vastly superior results insofar as silencing is concerned over previous devices which have been used.

I claim:

1. A silencer for a firearm comprising:

(a) a cylindrical tube having a longitudinal axis;

(b) means for attaching said tube to a muzzle of said firearm such tat said axis is coaxially aligned with the bore of said firearm;

(c) said tube having positioned in its interior a plurality of elements disposed for guiding of expanded gases and transmitting of sound waves from the end of said muzzle towards the outside of said tube, said elements being concentrically positioned along said axis of said tube, said elements including:

(1) a first flange member positioned within the interior of said tube; said flange member having a central conical portion with an opening within the apex end of said conical portion, said apex end facing the muzzle of said firearm, said opening concentric to said central conical portion, said flange member further having a truncated cone shaped surface located on the outer diameter of said member, the wider end of said truncated cone shaped surface facing said muzzle and being concentric with said tube axis; (2) a first hollow cylindrical member having an outer diameter smaller than the inside diameter of said tube and having a plurality of radial holes through its periphery; (3) a plurality of hollow conical baffling members in the form of truncated cones with their apexes facing said muzzle of said firearm, each said conical member positioned in sequence along the axis in the interior of said tube, each of said conical members having an array of holes substantially circularly disposed around the periphery of said conical members, said conical members having their widest end extended close to the interior surface of said tube, each said array of holes being located farther from the apex of its respective conical member than the array of the previous conical member;

(4) a second hollow cylindrical member having an outside diameter of said first cylinder and less than the inside diameter of said tube and having a array of radial holes disposed around the periphery, of said cylindrical member positioned such that the ends of said cylindrical member abuts the sides of said conical member;

(d) all of said elements firmly bonded together to form a first unit, said unit being fitted into said interior of said tube.

2. The device of claim 1 further comprising:

(a) a cylindrical mounting element adjacent an entrance end of said tube disposed for threading upon the muzzle of said firearm, said mounting element containing a plurality of holes in the end opposite said muzzle, and having an outer periphery which is firmly affixed within said tube;

(b) a second unit, identical to a said first unit but without a said flange member, said second unit positioned within said tube adjacent said cylindrical mounting element.

3. The device of claim 2 wherein said outer periphery of said cylindrical mounting element is firmly affixed within said entrance end of said tube by a press fit, and said entrance end of said tube is crimped and welded around said cylindrical mounting element.

4. The device of claim 6 further comprising an exit unit comprising an outer hollow cylindrical member concentrically disposed about said axis of said tube in the interior of the end of said tube opposite to said entrance end of said tube; a second flange member positioned within the interior of said outer hollow cylindrical member and disposed at the end of said outer hollow cylindrical member facing said muzzle; said second flange member shaped and oriented like said first flange member; said outer cylindrical member having a closed end surface at its end facing away from said muzzle, said end surface having a central opening concentrically disposed to said axis of said tube; an inner cylindrical member of smaller diameter than the inside diameter of said outer cylindrical member coaxially disposed within said outer cylindrical member, said inner cylindrical member having a plurality of radial holes therethrough.

5. The device of claim 4 wherein said exit unit is firmly affixed within said end of said tube opposite said entrance end by a press fit, and said tube is crimped and welded around said exit unit.

6. The device of claim 4 wherein said exit unit is firmly affixed within said end of said tube opposite said entrance end by threading.

7. The device of claim 1 comprising a plurality of said units coaxially positioned in series within said tube.

8. The device of claim 1 including a plurality of circular cooling fins positioned along the length of the outside of said tube; a protective cover over the upper half of said fins; a series of rods positioned longitudinally through the fins; a series of vents in said cover for ventilation; said fins being affixed to the exterior of said tube; said cover and said rods being affixed to said fins.

9. The device of claim 1 wherein said holes within each one of said conical baffling members are of substantially uniform size and said size of said holes within a given array increases as said conical members progress in sequence along said axis of said tube.

* * * * *